US010533272B2

(12) United States Patent
Dunn et al.

(10) Patent No.: US 10,533,272 B2
(45) Date of Patent: Jan. 14, 2020

(54) WASHING MACHINE APPLIANCE AND METHOD OF OPERATION

(71) Applicant: Haier US Appliance Solutions, Inc., Wilmington, DE (US)

(72) Inventors: David Scott Dunn, Smithfield, KY (US); Paul Owen Davis, Prospect, KY (US); John Andrew Schmelz, Charlestown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 179 days.

(21) Appl. No.: 15/468,211

(22) Filed: Mar. 24, 2017

(65) Prior Publication Data

US 2018/0274157 A1 Sep. 27, 2018

(51) Int. Cl.

*D06F 37/20* (2006.01)
*D06F 33/02* (2006.01)
*D06F 39/12* (2006.01)

(52) U.S. Cl.

CPC ..... *D06F 37/203* (2013.01); *D06F 33/02* (2013.01); *D06F 39/125* (2013.01); *D06F 2202/12* (2013.01); *D06F 2204/065* (2013.01); *D06F 2222/00* (2013.01)

(58) Field of Classification Search

CPC .... D06F 37/20; D06F 37/203; D06F 2222/00; D06F 49/06

See application file for complete search history.

(56) References Cited

U.S. PATENT DOCUMENTS 2,797,569 A * 7/1957 Kirby ..... D06F 37/24 210/365
6,530,100 B2 3/2003 Conrath
6,654,975 B2 12/2003 Broker
7,958,755 B2 6/2011 Lorenz et al.
2002/0120419 A1* 8/2002 Steffen ..... D06F 37/203 702/96
2007/0039104 A1* 2/2007 Lee ..... D06F 37/22 8/158
2010/0175199 A1* 7/2010 Kim ..... D06F 37/203 8/137
2016/0312394 A1* 10/2016 Wang ..... D06F 37/22

FOREIGN PATENT DOCUMENTS

DE 102015106849 A1 11/2016
WO WO-2015085791 A1 * 6/2015 ..... D06F 37/22

* cited by examiner

*Primary Examiner* — Marc Lorenzi
(74) *Attorney, Agent, or Firm* — Dority & Manning, P.A.

(57) ABSTRACT

A washing machine appliance and method of operation are generally provided herein. The washing machine appliance may include a cabinet, a first pair of diagonal feet, a second pair of diagonal feet, a tub, a basket, a measurement device, a motor, and a controller. The motor may be configured for selectively rotating the basket within the tub. The controller may be in operative communication with the motor and the measurement device. The controller may be configured for rotating the basket for a first period, monitoring movement of the cabinet between the first pair of diagonal feet and between the second pair of diagonal feet during the rotating, determining a first diagonal movement value, determining a second diagonal movement value, evaluating one or both of the diagonal movement values against a predetermined value, and transmitting a stability signal.

6 Claims, 9 Drawing Sheets

WASHING MACHINE APPLIANCE AND METHOD OF OPERATION

FIELD OF THE INVENTION

The present subject matter relates generally to washing machine appliances and methods for monitoring a stability state in such washing machine appliances.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Irrespective of the axis, washing machine appliances may include multiple corners or support feet on which a particular appliance rests. For such a washing machine appliance, a user or installer of the washing machine appliance may be required to set and/or adjust the feet to ensure the washing appliance is properly leveled or stable. If the washing machine appliance is not stable, performance of the washing appliance may be detrimentally affected. For instance, the cabinet may shake or rock, e.g., diagonally, between two opposite feet during operations. This unstable movement may generate excessive and undesirable noise. Moreover, the unstable movement may rapidly wear the floor or support surface on which the washing machine appliance is installed. Furthermore, the unstable movement may damage the washing machine appliance itself. Still further, the unstable movement can cause walking of the washing machine.

Although improper leveling of a washing machine appliance may cause certain disadvantages, it may be difficult for an individual to affirmatively determine whether the washing machine appliance is properly leveled. Moreover, even if the washing machine appliance is properly leveled during an initial installation, the washing machine appliance may be moved or slowly adjust over time such that the washing machine appliance is no longer properly leveled or stable. Without constant observation or releveling of the washing machine appliance, improper leveling or instability may be difficult to notice.

Accordingly, methods and apparatuses for determining a stability state of a washing machine appliance are desired. In particular, it would be advantageous for such methods and apparatuses to provide accurate and active monitoring of a stability state.

BRIEF DESCRIPTION OF THE INVENTION

Aspects and advantages of the invention will be set forth in part in the following description, or may be obvious from the description, or may be learned through practice of the invention.

In one aspect of the present disclosure, a method for operating a washing machine appliance is provided. The method may include rotating a basket for a first period, monitoring movement of a cabinet between a first pair of diagonal feet and between a second pair of diagonal feet during the rotating step, determining a first diagonal movement value for movement between the first pair of diagonal feet based on the monitoring step, determining a second diagonal movement value for movement between the second pair of diagonal feet based on the monitoring step, evaluating one or both of the diagonal movement values against a predetermined value, and transmitting a stability signal based on the evaluating step.

In another aspect of the present disclosure, a washing machine appliance is provided. The washing machine appliance may include a cabinet, a first pair of diagonal feet, a second pair of diagonal feet, a tub housed within the cabinet, a basket rotatably mounted within the tub, a measurement device mounted to the cabinet, a motor, and a controller. The pairs of diagonal feet may be mounted to a bottom portion of the cabinet. The basket may define a wash chamber for receipt of articles for washing. The motor may be in mechanical communication with the basket. Moreover, the motor may be configured for selectively rotating the basket within the tub. The controller may be in operative communication with the motor and the measurement device. The controller may be configured for rotating the basket for a first period, monitoring movement of the cabinet between the first pair of diagonal feet and between the second pair of diagonal feet during the rotating, determining a first diagonal movement value for movement between the first pair of diagonal feet based on the monitoring, determining a second diagonal movement value for movement between the second pair of diagonal feet based on the monitoring, evaluating one or both of the diagonal movement values against a predetermined value, and transmitting a stability signal based on the evaluating.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
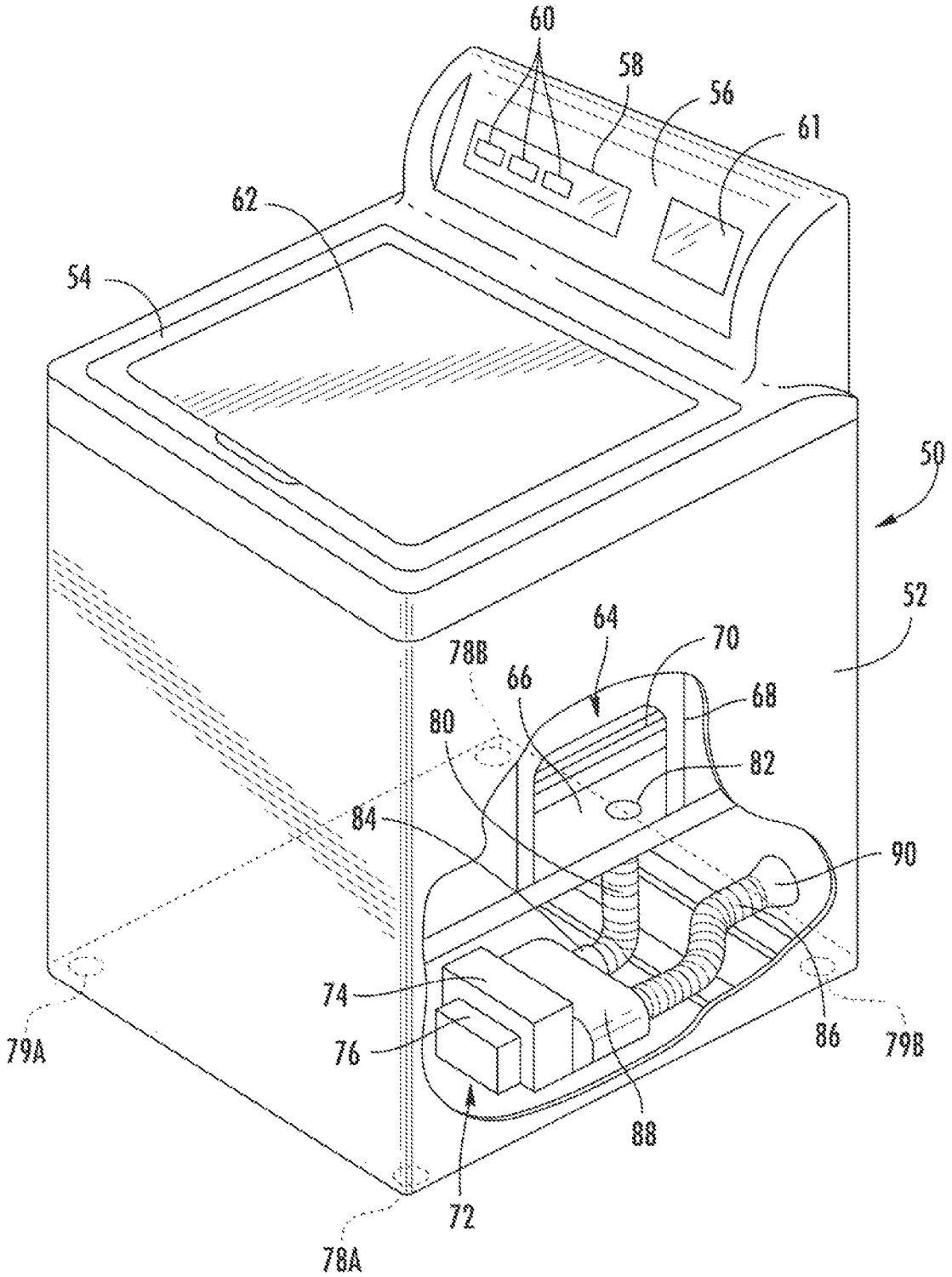
FIG. 1 provides a perspective view of a washing machine appliance, with a portion of a cabinet of the washing machine appliance shown broken away in order to reveal certain interior components of the washing machine appliance, in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an example embodiment of the present disclosure. As may be seen in FIG. 1, washing machine appliance 50 includes a cabinet 52 and a cover 54. A backsplash 56 extends from cover 54, and a control panel 58, including a plurality of input selectors 60, is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming an enclosure over wash tub 64.

One or more diagonal pairs of feet are generally provided on cabinet 52. For instance, cabinet 52 may include a first pair of diagonal feet 78 (i.e., 78A and 78B) and a second pair of diagonal feet 79 (i.e., 79A and 79B), both mounted at a bottom portion of cabinet 52, e.g., to rest on a floor or other support surface. In some such embodiments, each diagonal foot 78A, 78B, 79A, 79B may be diagonally-spaced and/or positioned at a separate corner of cabinet 52. The first pair of diagonal feet 78 may thus include a foot 78A at a front right corner and a foot 78B at a rear left corner. By contrast, the second pair of diagonal feet 79 may thus include a foot 79A at a front left corner and a foot 79B at a rear right corner. One or more of the feet 78A, 78B, 79A, 79B may be movable in the vertical direction V. For instance, a foot 78A, 78B, 79A, 79B may be formed as a mechanically adjusting (e.g., threaded) foot that can be raised or lowered relative to the rest of body of the cabinet 52.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

Generally, appliance 50 may define an X-axis, a Y-axis, and a Z-axis which are mutually orthogonal to each other. The Y-axis may extend along a longitudinal direction, and may thus be coaxial or parallel with a vertical direction V when the appliance is stable. Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
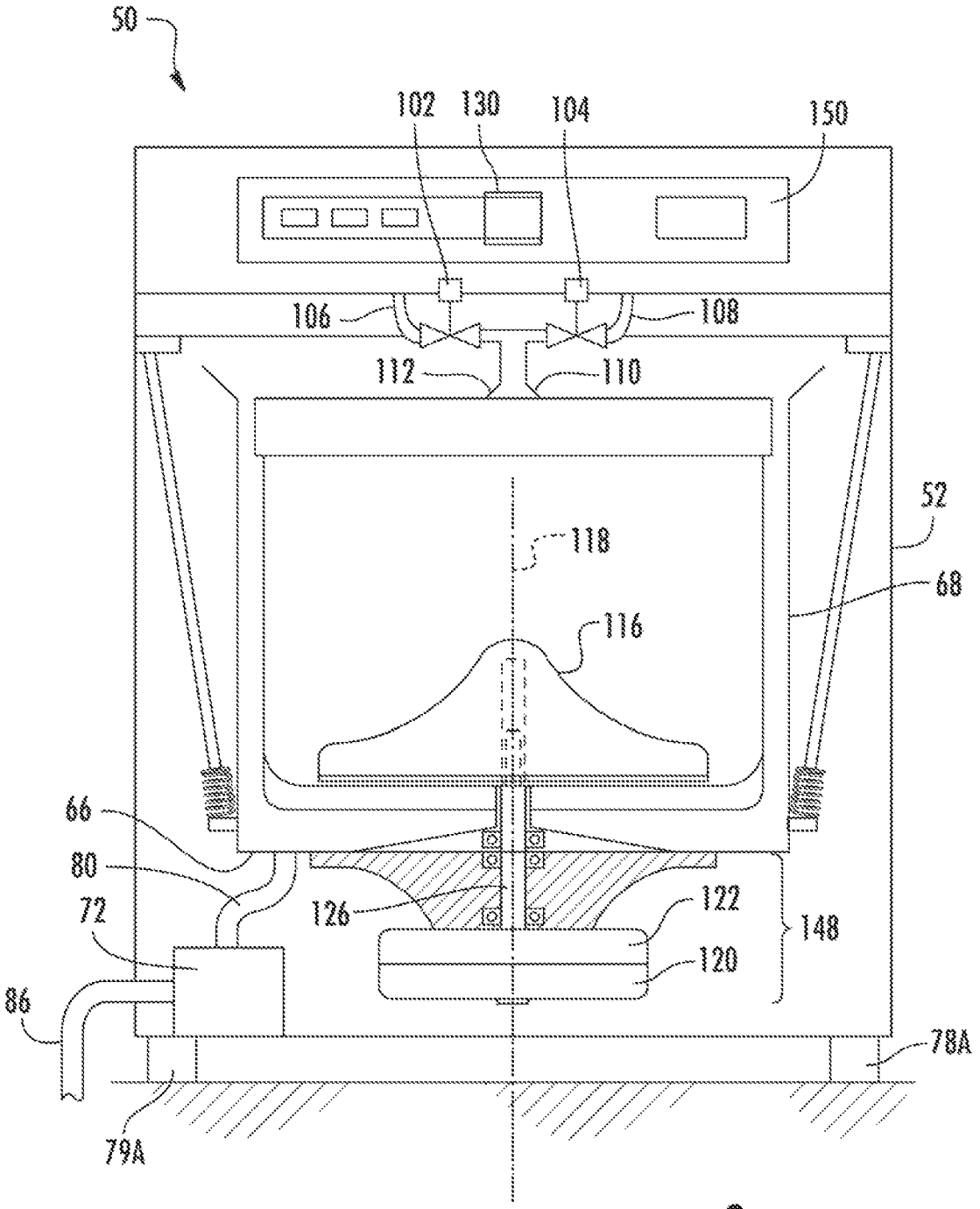
FIG. 2 provides a front elevation schematic view of various components of the washing machine appliance of FIG. 1.

FIG. 2 provides a front elevation schematic view of certain components of washing machine appliance 50, including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver liquid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown in FIG. 2), may also be provided to produce a liquid or wash solution by mixing fresh water with a known detergent and/or other additive for cleansing of articles in basket 70.

In some embodiments, an agitation element 116, such as a vane agitator, impeller, auger, or oscillatory basket mechanism, or some combination thereof, is disposed in basket 70 to impart an oscillatory motion to articles and liquid in basket 70. In various example embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148.

Operation of washing machine appliance 50 is controlled by a controller 150 that is operatively coupled to the control panel 58 (e.g., inputs 60 and/or display 60) located on washing machine backsplash 56 (shown in FIG. 1) for user manipulation to select washing machine cycles and features. In response to user manipulation of the control panel 58, controller 150 operates the various components of washing machine appliance 50 to execute selected machine cycles and features.

Controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 [such as motor assembly 148 and measurement devices 130 (discussed herein)] may be in communication with controller 150 via one or more signal lines or shared communication busses to provide signals to and/or receive signals from the controller 150. Optionally, measurement device 130 may be included with controller 150. Moreover, measurement devices 130 may include a microprocessor that performs the calculations specific to the measurement of motion with the calculation results being used by controller 150.

In an illustrative embodiment, laundry items are loaded into basket 70, and washing operation is initiated through operator manipulation of control input selectors 60 (FIG. 1). Tub 64 is filled with liquid such as water and mixed with detergent to form a wash fluid. Optionally, basket 70 is agitated with agitation element 116 for cleansing of laundry items in basket 70. That is, agitation element 116 is moved back and forth in an oscillatory back and forth motion about vertical axis 118, while basket 70 remains generally stationary (i.e., not actively rotated). In the illustrated embodiment, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

Before or after the agitation phase of the wash cycle is completed, tub 64 is drained with pump assembly 72. Laundry articles can then be rinsed by again adding liquid to tub 64. Depending on the particulars of the cleaning cycle selected by a user, agitation element 116 may further provide agitation within basket 70. After a rinse cycle, tub 64 is again drained, such as through use of pump assembly 72. After liquid is drained from tub 64, one or more spin cycles may be performed. In particular, a spin cycle may be applied after the agitation phase and/or after the rinse phase in order to wring excess wash fluid from the articles being washed. During a spin cycle, basket 70 is rotated at relatively high speeds about vertical axis 118, such as between approximately 450 and approximately 1300 revolutions per minute.

While described in the context of specific embodiments of washing machine appliance 50, using the teachings disclosed herein it will be understood that washing machine appliance 50 is provided by way of example only. Other washing machine appliances having different configurations (such as vertical and/or horizontal-axis washing machine appliances), different appearances, and/or different features may also be utilized with the present subject matter as well.

Referring now to FIGS. 3 through 6, one or more measurement devices 130 may be provided in the washing machine appliance 50 for measuring movement of the cabinet 52, for instance, while basket 70 spins during one or more phase of a wash cycle. As will be described in greater detail below, movement may be monitored as acceleration or displacement values detected from, for instance, one or more measurement devices 130. Measurement devices 130 may measure a variety of suitable variables, which can be correlated to movement of cabinet 52. The movement measured by such devices 130 can be utilized to monitor a stability state (e.g., as a stable state or an unstable state) of cabinet 52 and facilitate adjustments thereto.

Referring now to FIGS. 1 through 4, a measurement device 130 in accordance with the present disclosure may include an accelerometer that measures translational motion, such as acceleration along one or more directions. Additionally or alternatively, a measurement device 130 may include a gyroscope that measures rotational motion, such as rotational velocity about an axis. A measurement device 130 in accordance with the present disclosure is mounted to the cabinet 52. For instance, measurement device 130 may be mounted to the backsplash 56 to sense movement (e.g., pivotal and/or horizontal movement) of the cabinet 52 between one of the pairs of diagonal feet 78, 79 during operation of appliance 50.

In example embodiments, a measurement device 130 may include at least one accelerometer. The measurement device 130, for example, may be a printed circuit board which includes the accelerometer thereon. The measurement device 130 may be mounted to the cabinet 52 (e.g., via a suitable mechanical fastener, adhesive, direct attachment to a circuit board, etc.) and may be oriented such that various sub-components (e.g., the accelerometer and/or a gyroscope) are oriented to measure movement along or about particular directions as discussed herein. For instance, the measurement device 130 may be mounted within backsplash 56 to detect movement in a defined X'-axis, Y'-axis, and Z'-axis. Generally, the X'-axis, a Y'-axis, and a Z'-axis are mutually orthogonal to each other. Moreover, the X'-axis, a Y'-axis, and a Z'-axis may be fixed relative to the X-axis, a Y-axis, and a Z-axis. In some such embodiments, such as those shown in FIGS. 3 and 4, the X'-axis may be parallel to the X-axis, while the Y'-axis and Z'-axis are defined at an offset angle θ relative to the Y-axis and Z-axis, respectively. Alternatively, the accelerometer may be mounted within backsplash 56 to directly detect movement in the X-axis, Y-axis, and Z-axis, or any other suitable axes.

Figure 3:
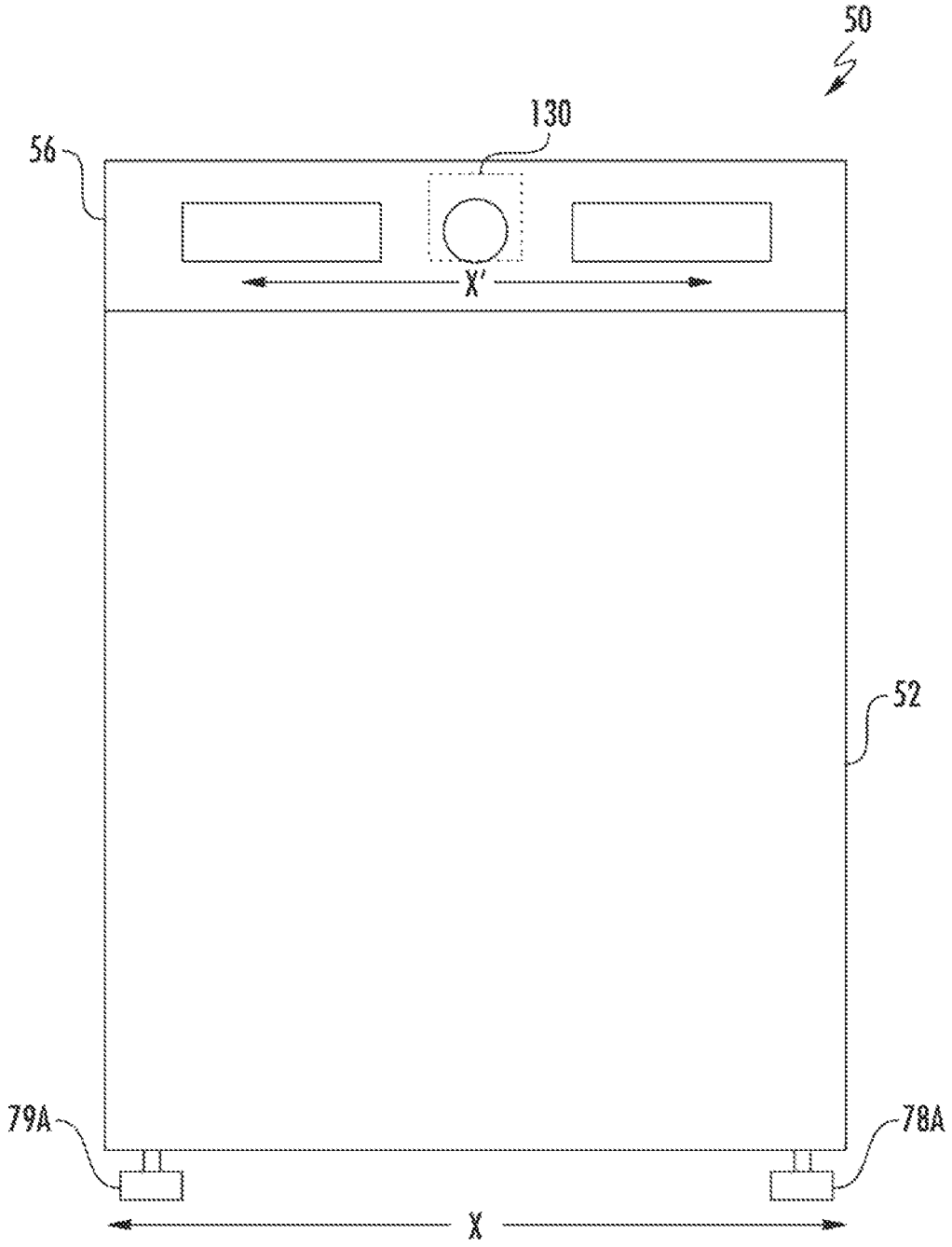
FIG. 3 provides a front plan view of an example washing machine appliance, in accordance with embodiments of the present disclosure.
Figure 4:
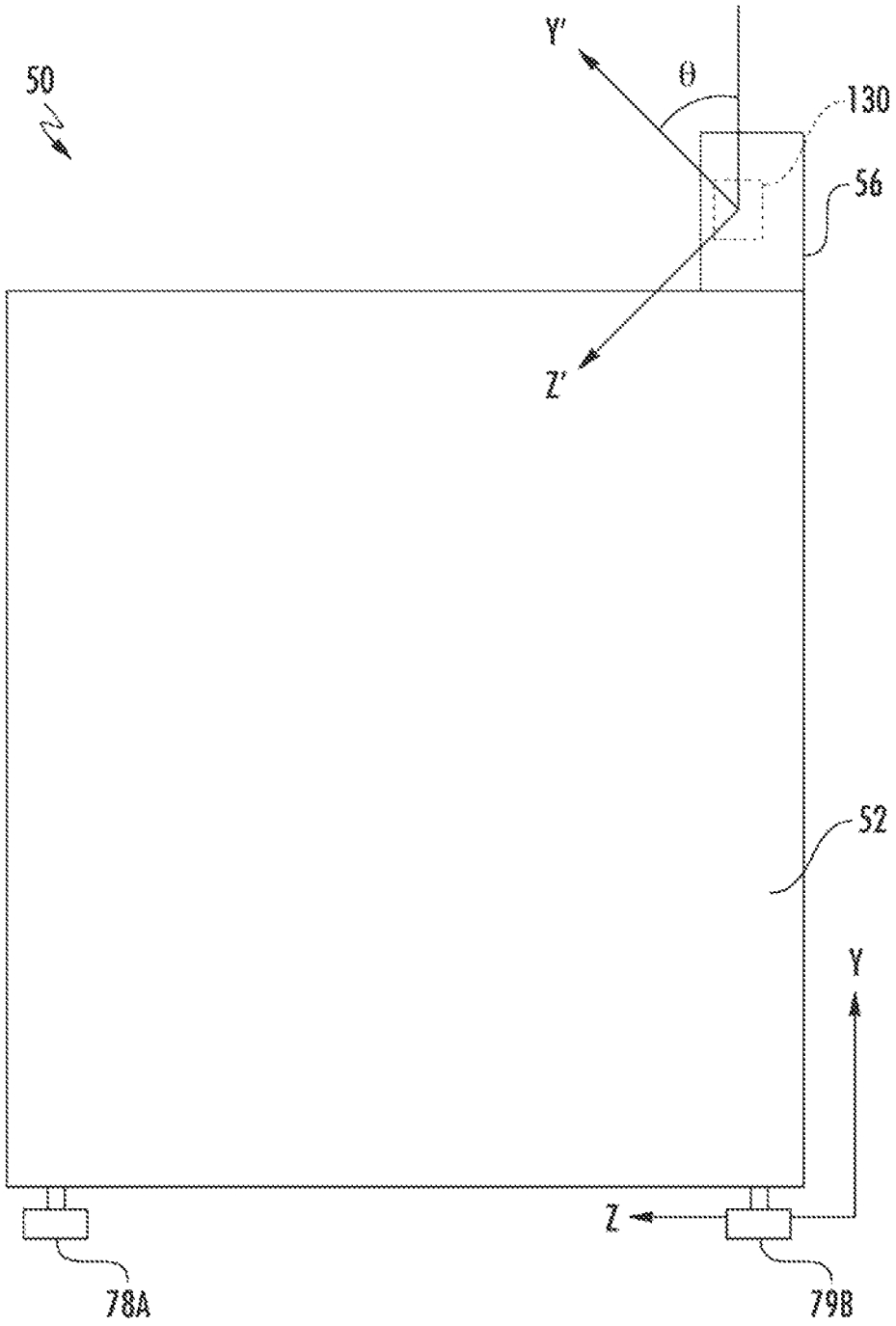
FIG. 4 provides a side plan view of the washing machine appliance of FIG. 3.

During operation of the appliance 50, movement between a diagonal pair of feet 78 or 79 (e.g., pivoting from one foot 78A or 79A of a pair of feet to the other foot 78B or 79B of the pair of feet) may be monitored at or from the measurement device 130. Specifically, the measurement device 130 may detect motion caused by pivoting between the pair of feet 78 or 79. In the embodiments of FIGS. 3 and 4, this motion is detected as initial acceleration components in an X'-axis, Y'-axis, and Z'-axis that may be transmitted to the controller 150.

In optional embodiments, initial acceleration components may be gathered continuously or during a predetermined stage or time period. As an example, monitoring or detection of initial acceleration components may be initiated in response to a set cycle or rotation speed. As another example, initial acceleration components may be gathered continuously during a time period, but only collected or further analyzed during a predetermined stage, e.g., at the set rotation speed. In some embodiments, acceleration components or data points are gathered, e.g., for a single revolution or multiple discrete revolutions of basket 70. In some such embodiments, controller 150 initiates collection of initial acceleration components in response to basket 70 reaching a set rotational velocity. The set rotational velocity may be between 400 revolutions per minute (rpm) and 1000 rpm. Additionally or alternatively, the set rotational velocity may be 600 rpm. Advantageously, basket 70 may be at a peak displacement period when initial acceleration components are gathered to efficiently and accurately collect information regarding stability of cabinet 52.

In example embodiments, controller 150 may be in operable communication with a rotational speed sensor (not pictured) on motor assembly 48 to detect rotational velocity of motor 120. Detection of the set rotation speed may subsequently cause controller 150 to collect initial acceleration components from the measurement device 130.

Upon being received, e.g., at the controller 150, initial acceleration components may be filtered to remove unreliable data points or components caused by offset of the mean value and/or signal noise. Additionally or alternatively, initial or filtered acceleration components may be resolved, e.g., at the controller 150, as horizontal acceleration components perpendicular to the Y-axis and/or vertical direction V. As an example, a Z'-axis component (z'), a Y'-axis component (y'), and X'-axis component (x') may be resolved components perpendicular to the Y-axis and/or vertical direction V. The Z'-axis component (z') and Y'-axis component (y') may be resolved as a Z-axis component based on the offset angle θ [e.g., according to $z=y' \sin(\theta)+z' \cos(\theta)$]. As shown in FIG. 3, an X'-axis component (x') may be equal to an X-axis component (x).

Figure 5:
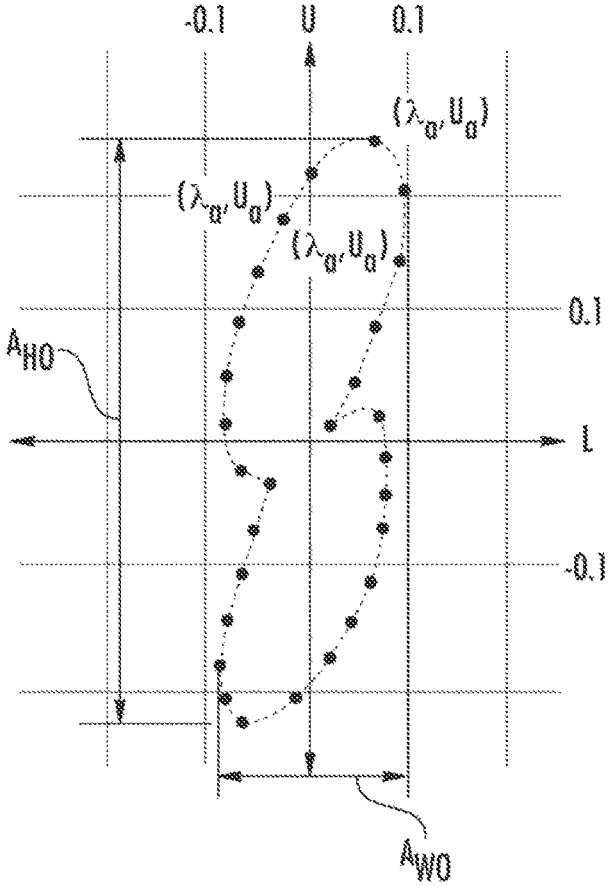
FIG. 5 provides an example chart of mapped acceleration of a washing machine appliance according to example embodiments of the present disclosure, wherein the washing machine appliance is in a stable state.
Figure 6:
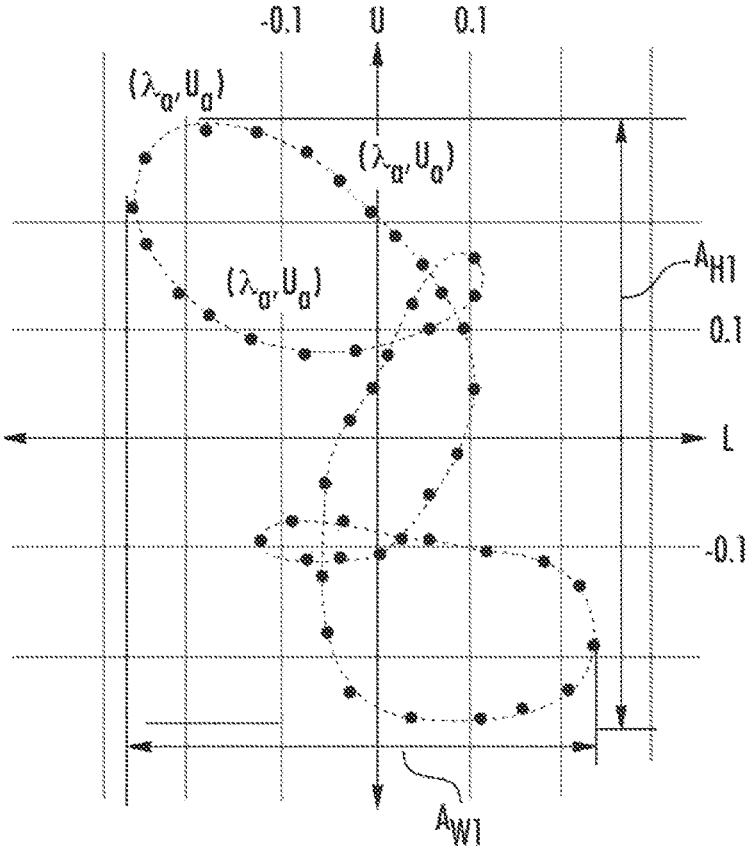
FIG. 6 provides an example chart of mapped acceleration of a washing machine appliance according to example embodiments of the present disclosure, wherein the washing machine appliance is in an unstable state.

As another example, a rotated horizontal plane may be defined perpendicular to the Y-axis and/or vertical direction V, as shown in FIGS. 5 and 6. The rotated horizontal plane may define an upright diagonal axis (U-axis) and a lateral diagonal axis (L-axis) upon which an acceleration profile may be mapped (e.g., in units of gravitational or G-force). The U-axis is understood to be parallel to one pair of diagonal feet [e.g., the second pair of diagonal feet 79 (FIG. 1)] while the L-axis is understood to be parallel to another pair of diagonal feet [e.g., the first pair of diagonal feet 78 (FIG. 1)]. In other words, acceleration in the general direction of the back right foot 79B may be indicated on the positive end of the U-axis, acceleration in the general direction of the front left foot 79A may be indicated on the negative end of the U-axis, acceleration in the general direction of the front right foot 78A may be indicated on the positive end of the L-axis, and acceleration in the general direction of the back left foot 78B may be indicated on the negative end of the L-axis. In turn, and as would be understood by one of ordinary skill, the Z'-axis component (z'), Y'-axis component (y'), and X'-axis component (x') may be resolved as a unique U-axis component (e.g., $U_a$) and L-axis component (e.g., $\lambda_a$).

In some embodiments, resolved horizontal acceleration components may be used to evaluate stability. As shown in FIGS. 5 and 6, monitoring may include measuring acceleration at an accelerometer of measurement device 130. FIG. 5 generally illustrates an example of mapped acceleration components ($\lambda_a$, $U_a$) measured during a rotation in which cabinet 52 was in one stability state, e.g., a stable state. In other words, each pair of feet 78, 79 is shown substantially even and/or fully supported on a floor or support surface. FIG. 6 generally illustrates an example of mapped acceleration components ($\lambda_a$, $U_a$) measured during a rotation in which cabinet 52 was in another stability state, e.g., an unstable state. In other words, at least one pair of feet 78 or 79 is spaced apart from and/or not fully supported on a floor or support surface. Each of FIGS. 5 and 6 illustrate mapped acceleration in a plane (U-L) perpendicular to the vertical direction V. The origin [i.e., (0, 0)] is understood to represent the position of the measurement device 130 when washing machine appliance 50 is stationary and/or inactive or off.

As shown, an unstable state may transform the mapped acceleration components or profile during a rotation of basket 70 (FIG. 2). In certain embodiments, multiple unique diagonal acceleration values are determined from the mapped acceleration components. For instance, an acceleration value (e.g., first acceleration value) may be determined from the width or span $A_W$ of acceleration components in the L-axis (i.e., the acceleration range between the first diagonal pair of feet 78). Another acceleration value (e.g., second acceleration value) may be determined from the height or span $A_H$ of acceleration components in the U-axis (i.e., the acceleration range between the second diagonal pair of feet 79). Once determined, the acceleration value(s) (e.g., $A_{W1}$ and/or $A_{H1}$) may be evaluated against predetermined acceleration value(s) (e.g., $A_{W0}$ and/or $A_{H0}$). Specifically, the predetermined acceleration value(s) may be set according to a mapped acceleration profile, such as that shown in FIG. 5 (e.g., gathered from test data of an example washing machine unit).

If the determined acceleration value(s) exceed the predetermined acceleration value(s) (e.g., by a predetermined amount or percentage), cabinet 52 may be evaluated as being in an unstable state. By contrast, if the determined acceleration value(s) are equal to or less than the predetermined acceleration value(s) (e.g., by a predetermined amount or ratio), cabinet 52 may be evaluated as being in a stable state.

Advantageously, evaluation of diagonal movement (e.g., as acceleration) may facilitate a stability state determination using relatively few collected data points and/or calculations. Moreover, using measurements gathered, e.g., at measurement device 130 (FIG. 2), the stability state determination may be made using relatively few and/or inexpensive components.

In optional embodiments, multiple determined acceleration values are evaluated together as a ratio value (e.g., a first acceleration value over second acceleration value). In such embodiments, the predetermined value may also be a ratio value (e.g., set according to a mapped acceleration profile). The two ratio values may be compared in evaluating whether cabinet 52 is in a stable or unstable state. For instance, if the determined acceleration ratio value exceeds the predetermined acceleration ratio value by greater than a predetermined amount or percentage, the cabinet 52 may be unstable.

Figure 7:
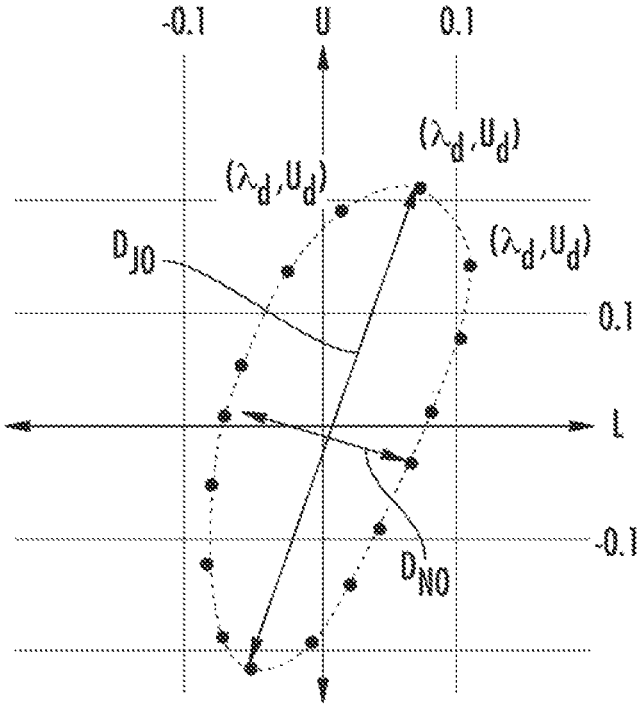
FIG. 7 provides an example chart of mapped displacement of a washing machine appliance according to example embodiments of the present disclosure, wherein the washing machine appliance is in a stable state.
Figure 8:
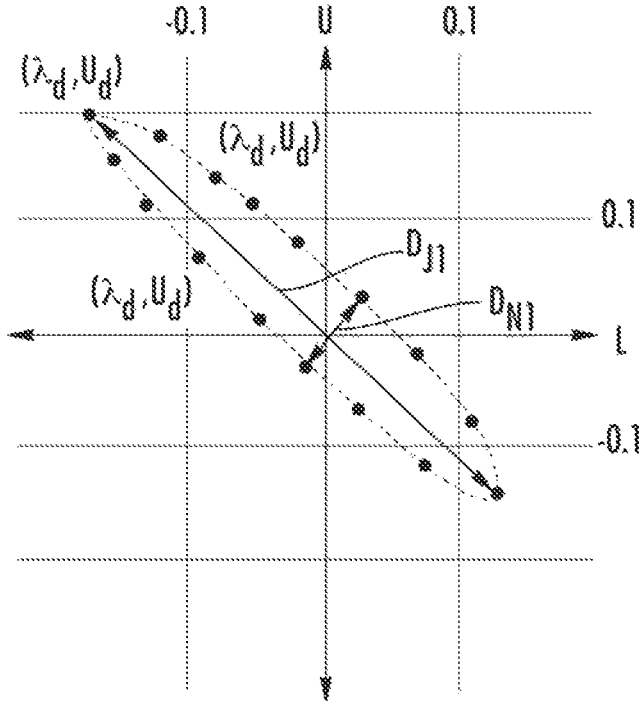
FIG. 8 provides an example chart of mapped displacement of a washing machine appliance according to example embodiments of the present disclosure, wherein the washing machine appliance is in an unstable state.

Turning now to FIGS. 7 and 8, in certain embodiments, monitoring includes determining displacement of cabinet 52 (FIG. 2). For instance, displacement may be calculated as horizontal displacement components (e.g., via double integration of resolved acceleration components) perpendicular to the vertical direction V. Each of FIGS. 7 and 8 illustrate mapped displacement in a plane (U-L) perpendicular to the vertical direction V upon which a displacement profile may be mapped (e.g., in units of inches).

FIG. 7 generally illustrates an example of mapped displacement components ($\lambda_d$, $U_d$) calculated from acceleration components ($\lambda_d$, $U_d$) (e.g., FIG. 5) measured during a basket 70 (FIG. 2) rotation in which cabinet 52 (FIG. 2) was in a stable state. In other words, each pair of feet 78, 79 (FIG. 1) is shown substantially even and/or supported on a floor or support surface. FIG. 8 generally illustrates an example of mapped displacement components ($\lambda_d$, $U_d$) calculated from acceleration components ($\lambda_d$, $U_d$) (e.g., FIG. 6) measured during a basket 70 rotation in which cabinet 52 was in an unstable state. In other words, at least one pair of feet 78 or 79 is spaced apart from and/or not fully supported on a floor or support surface. The origin [i.e., (0, 0)] is understood to represent the position of the measurement device 130 when cabinet 52 is stationary and/or inactive or off. The U-axis is understood to be parallel to one pair of diagonal feet (e.g., the second pair of diagonal feet 79) while the L-axis is understood to be parallel to the other pair of diagonal feet (e.g., the first pair of diagonal feet 78). In other words, displacement in the general direction of the back right foot 79B may be indicated on the positive end of the U-axis, displacement in the general direction of the front left foot 79A may be indicated on the negative end of the U-axis, displacement in the general direction of the front right foot 78A may be indicated on the positive end of the L-axis, and displacement in the general direction of the back left foot 78B may be indicated on the negative end of the L-axis.

As shown, an unstable state may change or transform the mapped displacement components during a rotation of basket 70. Specifically, the displacement of an unstable state may be mapped as an elongated ellipse. In certain embodiments, multiple unique diagonal displacement values are determined from the mapped displacement components. For instance, a displacement value (e.g., first displacement value) may be determined from the major diameter $D_{J1}$ of the displacement ellipse. Another displacement value (e.g., second displacement value) may be determined from the minor diameter $D_{N1}$ of the displacement ellipse. Once determined, the displacement value(s) (e.g., $D_{J1}$ and/or $D_{N1}$) may be evaluated against predetermined displacement value(s) (e.g., $D_{J0}$ and/or $D_{N0}$). Specifically, the predetermined displacement value(s) may be set according to a mapped displacement profile, such as that shown in FIG. 7 (e.g., gathered from test data of an example washing machine unit). If the determined displacement value(s) exceed the predetermined displacement value(s), cabinet 52 may be evaluated as being in an unstable state. By contrast, if the determined displacement value(s) are equal to or less than the predetermined displacement value(s), cabinet 52 may be evaluated as being in a stable state. Advantageously, evaluation of diagonal movement (e.g., as displacement) may facilitate a stability state determination using relatively few collected data points and/or calculations. Moreover, using measurements gathered, e.g., at measurement device 130 (FIG. 2), the stability state determination may be made using relatively few and/or inexpensive components.

In optional embodiments, one or more determined displacement value may be evaluated against a predetermined displacement value in isolation. For instance, a maximum absolute value of displacement components ($\lambda_d$, $U_d$) may be identified. As an example, a maximum absolute value of displacement components ($\lambda_d$, $U_d$) along the displacement profile may be identified as displacement in a single axis. In other words, the magnitude of distance from the origin along the U-axis or L-axis (i.e., represented by the value of the extreme $U_d$ or $\lambda_d$, respectively). As another example, a maximum absolute value of displacement components identified as displacement in the perpendicular plane (U-L). In other words, the magnitude of distance from an extreme displacement component $\lambda_d$, $U_d$ to the origin [i.e., $\approx(U_d^2+\lambda_d^2)$]]. In some embodiments, the predetermined value may be a threshold displacement value. If a displacement value is determined to exceed the predetermined displacement value, cabinet 52 may be evaluated as being in an unstable state. If no displacement value is equal to or less than the predetermined displacement value, cabinet 52 may be evaluated as being in a stable state.

In additional or alternative embodiments, multiple determined displacement values are evaluated together as a displacement ratio value. For instance, the displacement profile may be formed in a generally elliptical shape. A major diameter $D_{J1}$ a minor diameter $D_{N1}$ may be identified. In turn, the diameters $D_{J1}$, $D_{N1}$ may be evaluated as a ratio [e.g., major diameter $D_{J1}$ over minor diameter $D_{N1}$ ($D_{J1}/D_{N1}$)]. In such embodiments, the predetermined value may also be a ratio value [e.g., set according to a displacement profile as ($D_{J0}/D_{N0}$)]. The two ratio values may be compared in evaluating whether cabinet 52 is in a stable or unstable state. For instance, a displacement ratio ($D_{J1}/D_{N1}$) that is greater than three times the predetermined ratio value ($D_{J0}/D_{N0}$) may indicate an unstable state. Advantageously, the shape of a determined or mapped displacement profile may be evaluated with relatively few collected data values.

In further additional or alternative embodiments, once an unstable state has been determined, the unstable pair of feet 78 or 79 may be identified. In other words, one of 78 or 79 may be identified as unstable. In some such embodiments, identifying the unstable pair includes determining an extreme or maximum displacement component in a single mapped axis (e.g., U-axis). Once identified, the coordinate values of the extreme displacement component may be multiplied (e.g., as component $U_d$ times component $\lambda_d$) before analyzing the resulting value. The resulting value may indicate which of the pairs of feet 78 or 79 are unstable. For instance, a positive resulting value (i.e., greater than 0) may indicate one pair of feet 78 is unstable while a negative resulting value (i.e., less than 0) indicates the other pair of feet 79 is unstable.

Figure 9:
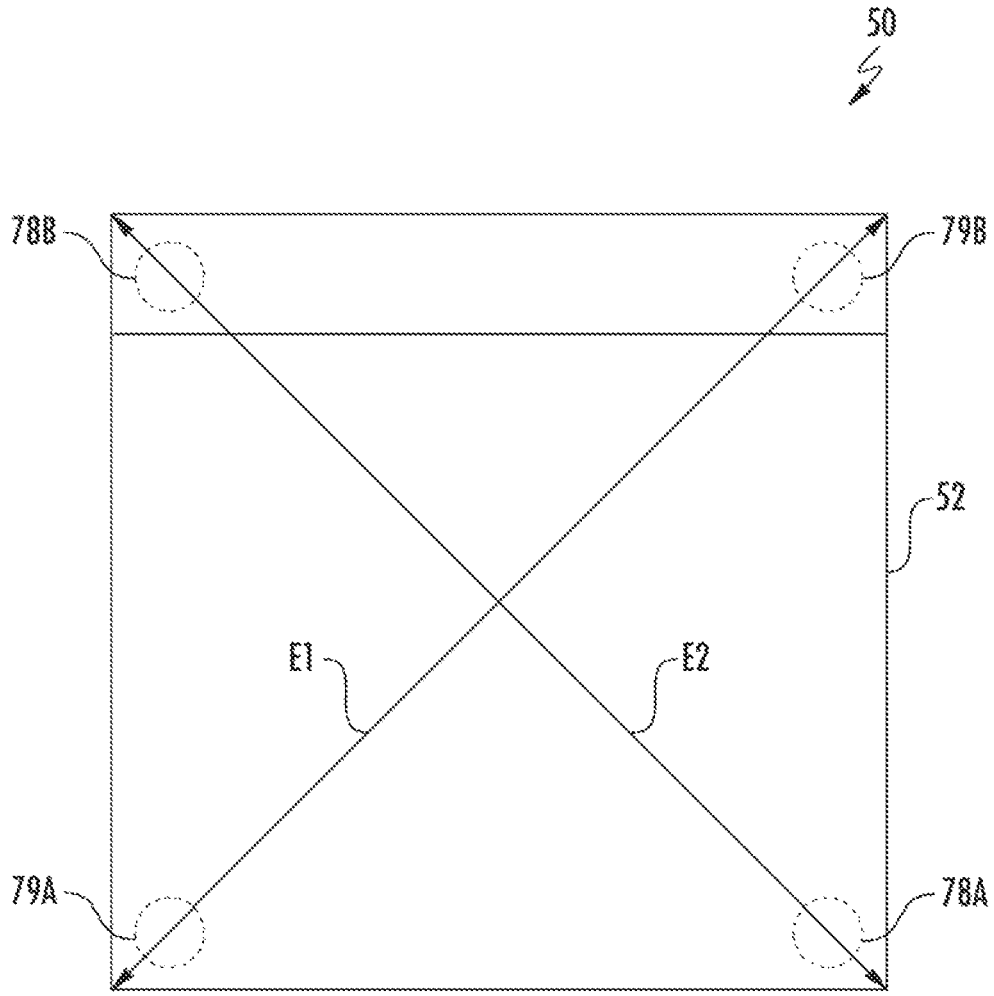
FIG. 9 provides a top plan view of the washing machine appliance of FIG. 1, wherein the washing machine appliance is in a stable state.
Figure 10:
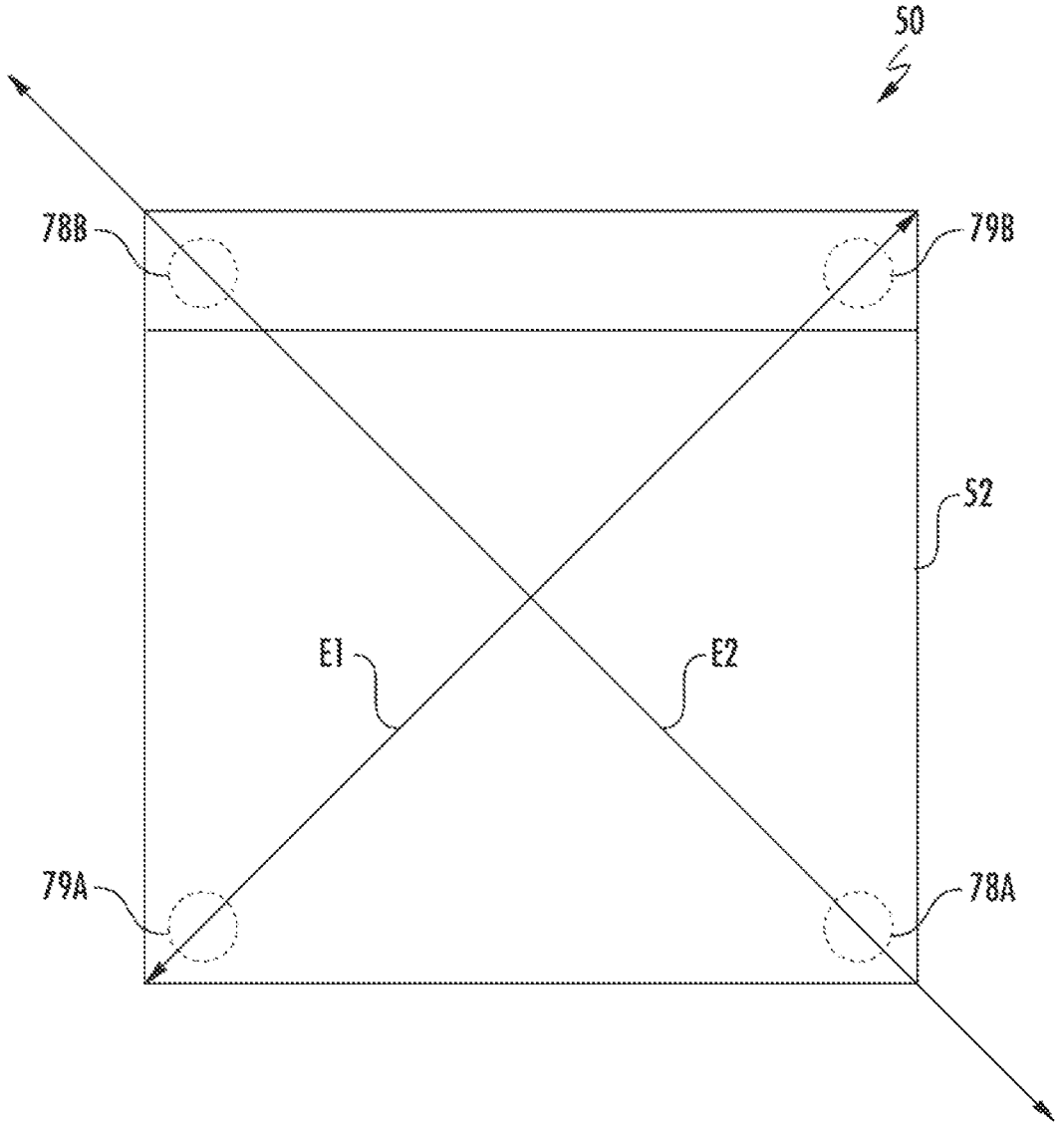
FIG. 10 provides a top plan view of the washing machine appliance of FIG. 1, wherein the washing machine appliance is in an unstable state.

As shown in FIGS. 9 and 10, in certain embodiments, diagonal movement values are provided as displacement vectors (e.g., $E_1$, $E_2$). The displacement vectors $E_1$, $E_2$ may be measured or calculated based on detected motion monitored at, e.g., measurement device 130 (FIG. 2). Each displacement vector $E_1$, $E_2$ generally indicates movement perpendicular to the vertical direction V (FIG. 2) between the pairs of feet 78, 79 (FIG. 1). For instance, the first displacement vector E1 may indicate movement between the first pair of diagonal feet 78 while the second displacement vector E2 indicates movement between the second pair of diagonal feet 79. Moreover, each vector $E_1$ or $E_2$ may be substantially perpendicular to the other $E_2$ or $E_1$. As used herein with respect to angles, "substantially" is understood to be within 15°. During use, each displacement vector $E_1$, $E_2$ may be determined separately during one or more rotation of basket 70 (FIG. 2).

In some embodiments, the vectors $E_1$, $E_2$ are evaluated together as a vector ratio value [e.g., first displacement vector $E_1$ over second displacement vector $E_2$ ($E_1/E_2$)]. In such embodiments, a predetermined ratio value may be provided. The two ratio values may be compared in evaluating whether cabinet 52 (FIG. 2) is in a stable or unstable state. If the vector ratio value is equal to or less than the predetermined ratio value, the cabinet 52 may be in a stable state. If the vector ratio value is greater than the predetermined ratio value, the cabinet 52 may be in an unstable state.

Returning to FIGS. 1 and 2, it is understood that once an evaluation of unstable state is made, a stability signal may be transmitted. The stability signal may indicate the presence and/or magnitude of the instability. For instance, controller 150 may transmit a stability signal to control panel 58 and/or display 61, e.g., via one or more wired connections or busses. At the user interface an audio and/or visual alert signal may be generated. Additionally or alternatively, the stability signal may be transmitted to a secondary device, such as a remote computer, tablet, or smart phone (not pictured), (e.g., via one or more wireless connection protocol in a band between 2.4 GHz and 2.485 GHz. In further embodiments, in an unstable state is determined (e.g., one or more diagonal movement values exceed a predetermined value) rotation of the basket 70 may be halted.

Figure 11:
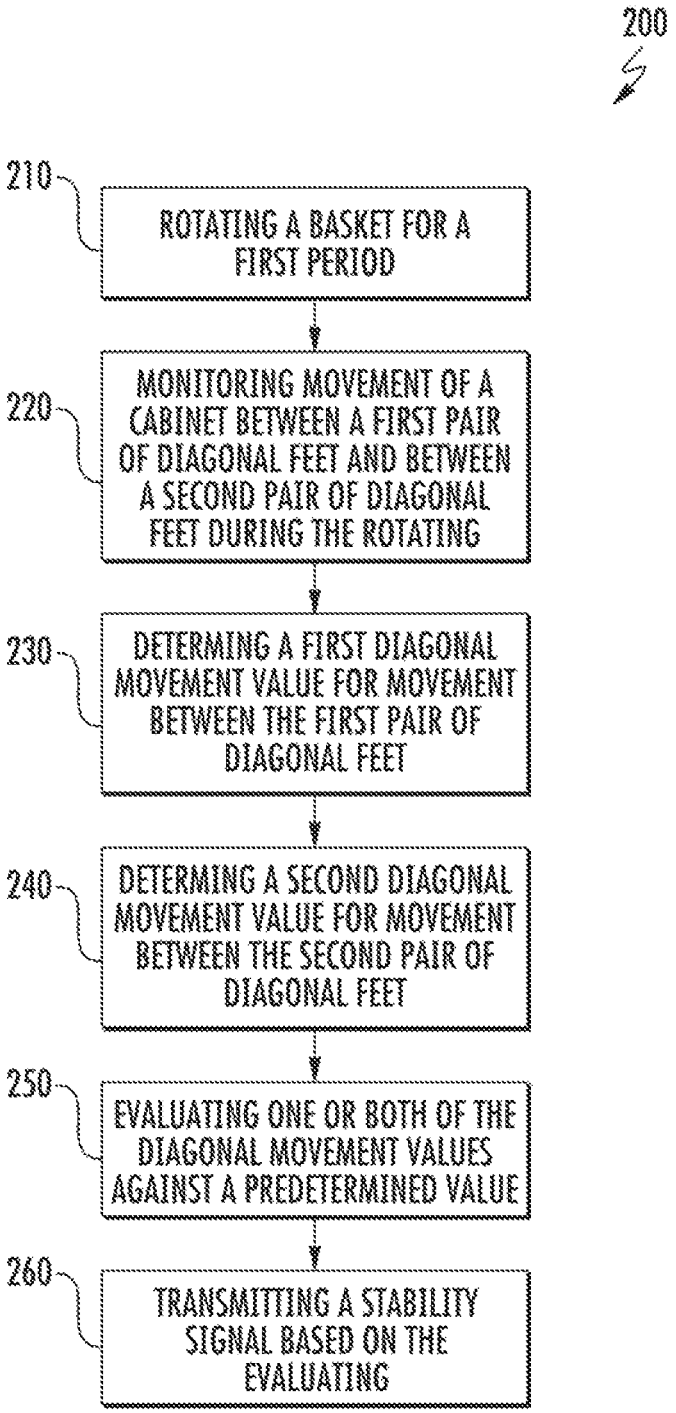
FIG. 11 provides a flow chart illustrating a method for operating a washing machine appliance in accordance with embodiments of the present disclosure.

Referring now to FIGS. 11 and 12, various methods may be provided for use with washing machine appliances 50 (FIG. 2) in accordance with the present disclosure. In general, the various steps of methods as disclosed herein may, in example embodiments, be performed by the controller 150 (FIG. 2), which may receive inputs and transmit outputs from various other components of the appliance 50. In particular, the present disclosure is further directed to methods, as indicated by reference number 200, for operating washing machine appliances 50. Such methods advantageously facilitate monitoring of stability states, the positioning of diagonal pairs of feet, and solutions for improving stability. In example embodiments, such balancing is performed during the agitation phase, before draining and subsequent rinse cycles, spin cycles, etc.

A method 200 may, for example, include the step 210 of rotating the basket for a first period. For instance, the first period may be a defined period of time and/or rotational velocities programmed into the controller. Moreover, the first period may be dependent upon the size of the load of articles and other variables which may, for example, be input by a user interacting with a control panel and input selectors thereof. In some embodiments, rotating includes rotating the basket to a rotational velocity of between 400 rpm and 1000 rpm. In specific embodiments, the rotational velocity may be 600 rpm. Optionally, rotation may take place during a spin or rinse cycle, e.g., after flowing a volume of liquid into the tub and/or agitating articles within tub.

Method 200 may further include, for example, the step 220 of monitoring movement of the cabinet between the first pair of diagonal feet and between the second pair of diagonal feet during the rotating. In some embodiments, step 220 includes measuring acceleration at an accelerometer attached to the cabinet, as described above. Additionally or alternatively, step 220 may include calculating displacement of the cabinet. Upon being received at controller, acceleration and/or displacement may be mapped in a plane perpendicular to a vertical direction.

Method 200 may further include, for example, the steps 230 and 240 of determining a first diagonal movement value for movement between the first pair of diagonal feet and determining a second diagonal movement value for movement between the second pair of diagonal feet, respectively. One or both of 230 and 240 may be based on the monitoring of step 220. In some such embodiments, the determined diagonal movement values are acceleration values. In alternative embodiments, the determined diagonal movement values are displacement values. As an example, the diagonal movement values may be first and second displacement values. As another example, the diagonal movement values may include a first and second displacement vector, wherein the second displacement vector is substantially perpendicular to the first displacement vector.

Method 200 may further include, for example, the step 250 of evaluating one or both of the diagonal movement values against a predetermined value. As described above, the predetermined value may be a set threshold value. The step 250 may include evaluating one or both of the diagonal movement values as maximum absolute values. Alternatively, the step 250 may include evaluating the diagonal movement values together as a ratio. In some such embodiments, 250 includes determining a ratio value of the first movement value to the second movement value, and subsequently comparing the ratio value to the predetermined value.

Method 200 may further include, for example, the step 260 of transmitting a stability signal based on the evaluating, as described above. In some such embodiments, 260 includes directing the stability signal to a user interface or control panel. Moreover, 260 may include directing the stability signal to a secondary device. Additionally or alternatively, 260 may include halting or altering (e.g., altering a time/speed profile for rotation) of the basket in response to an evaluation that one or both diagonal movement values exceed the predetermined value. In other words, in response to an unstable state. The basket may thus be halted if it is determined that the washing machine appliance or cabinet is in an unstable state.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, comprising:

a cabinet;

a first pair of diagonal feet mounted to a bottom portion of the cabinet, the first pair of diagonal feet comprising a rear left foot and a front right foot;

a second pair of diagonal feet mounted to the bottom portion of the cabinet, the second pair of diagonal feet comprising a rear right foot and a front left foot;

a tub housed within the cabinet;

a basket rotatably mounted within the tub, the basket defining a wash chamber for receipt of articles for washing;

a measurement device mounted to the cabinet;

a motor in mechanical communication with the basket, the motor configured for selectively rotating the basket within the tub; and a controller in operative communication with the motor and the measurement device, the controller configured for:

rotating the basket for a first period, monitoring movement of the cabinet between the first pair of diagonal feet and between the second pair of diagonal feet during the rotating, determining a first diagonal movement value for movement from the rear left foot to the front right foot based on the monitoring, determining a second diagonal movement value for movement from the rear right foot to the front left foot based on the monitoring, determining a ratio value of the first diagonal movement value to the second diagonal movement value, and comparing the ratio value to a predetermined ratio value, and transmitting, based on the comparing, a stability signal relating to a stability condition of the cabinet relative to a floor therebelow.

2. The washing machine appliance of claim 1, wherein the measurement device comprises an accelerometer, wherein the monitoring comprises measuring acceleration at the accelerometer, wherein the first diagonal movement value is a first acceleration value, and wherein the second diagonal movement value is a second acceleration value.

3. The washing machine appliance of claim 1, wherein the monitoring comprises calculating displacement of the cabinet, wherein the first diagonal movement value is a first displacement value, and wherein the second diagonal movement value is a second displacement value.

4. The washing machine appliance of claim 1, wherein the monitoring comprises mapping displacement of the cabinet in a plane perpendicular to the vertical direction, wherein the first diagonal movement value is a first displacement value, and wherein the second diagonal movement value is a second displacement value.

5. The washing machine appliance of claim 1, wherein the determining the first diagonal movement value comprises determining a first displacement vector, and wherein determining the second diagonal movement value comprises determining a second displacement vector substantially perpendicular to the first displacement vector.

6. The washing machine appliance of claim 1, wherein the rotating comprises rotating the basket to a rotational velocity of between 400 and 1000 revolutions per minute.

* * * * *